United States Patent [19]

Leggiere et al.

[11] 4,070,843

[45] Jan. 31, 1978

[54] SIMULATED SHINGLE ARRANGEMENT

[76] Inventors: Robert Leggiere, 34 Whitlaw Lane, Chappaqua, N.Y. 10514; Michael Frank Saggese, 2140 Old Hickory Blvd., Nashville, Tenn. 37215

[21] Appl. No.: 751,416

[22] Filed: Dec. 16, 1976

[51] Int. Cl.[2] ..... E04D 3/362

[52] U.S. Cl. ..... 52/521; 52/558; 52/316

[58] Field of Search ..... 52/558, 557, 555, 521, 52/542, 520, 526, 536, 539, 547, 313, 316

[56] References Cited

U.S. PATENT DOCUMENTS

| | | | |
|---|---|---|---|
| 3,312,031 | 4/1967 | Berg | 52/558 |
| 3,593,479 | 7/1971 | Hinds | 52/555 |
| 3,862,532 | 1/1975 | Markos | 52/521 |
| 3,897,667 | 8/1975 | Turek | 52/555 |
| 4,001,997 | 1/1977 | Saltzman | 52/555 |

*Primary Examiner*—J. Karl Bell
*Attorney, Agent, or Firm*—James P. Scullin

[57] ABSTRACT

A simulated shingle arrangement having novel interlocking connections between adjacent shingles in the same course as well as between adjacent shingles in adjacent courses is provided. The arrangement can comprise individual shingles each having the novel interlocking connecting means as an integral part thereof, but preferably comprises elongated panels each simulating a plurality of individual shingles in side-by-side relation. As in the case of individual shingles, the novel interlocking connecting means forms an integral part of such elongated multi-shingle panels. The outer surface of the shingles can simulate the appearance of conventional shingles, such as cedar shakes, as desired.

6 Claims, 7 Drawing Figures

10
12
14
16
18
20
22
24
26
28
30
32
34
36
38
40
42
19a
21
21a
23
23a
25a
27
27a
29
29a
31a
33
33a
35
35a
37a
39
39a
41
41a
A
44
46
50
52
54
56
58
60

SIMULATED SHINGLE ARRANGEMENT

BACKGROUND OF THE INVENTION

1. Field of the Invention

This invention relates to the siding and roofing art, and in particular to improvements in interlocking shingle arrangements which simulate the appearance of conventional shingles, such as cedar shakes.

2. Description of the Prior Art

Conventional shingles, including those made of wood, concrete/asbestos, clay, asphalt, and metal have not been found to be satisfactory in all respects. The small size of individual conventional shingles makes covering a wall or roof time-consuming, as well as expensive due to the large amount of labor required. In addition, such shingles suffer variously from other shortcomings such as attack by microorganisms, necessity for periodic painting, flammability, lack of impact resistance, excess weight, and lack of resistance to wind damage.

There have been some attempts in the prior art to overcome the problems of the time and labor expense required to install individual shingles through the provision of large panels which simulate the appearance of a plurality of shingles in a single piece. None of these attempts have been completely successful, for various reasons. In some cases the large panels were too heavy and unwieldy to be easily handled by one person, thus partially defeating the purpose of minimizing labor cost.

Another of the problems with prior art shingles, both individual shingles and multi-shingle panels, has been the lack of a satisfactory interlocking device between adjacent courses. Although interlocking devices between adjacent shingles in the same course, i.e., between two shingles in side-by-side relation, have been disclosed, in general there has been no satisfactory provision for interlocking shingles in adjacent courses, i.e., between two shingles in top-to-bottom relation. This has often resulted in wind forces loosening, raising, or even removing shingles or an entire panel of shingles. In addition, some of the prior art locking devices entail the use of separate pieces or require very precise alignment during installation, thus defeating the purpose of simplifying installation and saving labor costs.

SUMMARY OF THE INVENTION

It is the object of the present invention to provide a simulated shingle arrangement having an improved and simplified interlocking system, wherein adjacent shingles in a given course as well as adjacent shingles in adjacent courses are interlocked in such a manner as to be impervious to rain and virtually completely free from wind force damage. This object is achieved in an economical fashion and does not require the use of separate clips or other fasteners. The shingle arrangements are simple to align, and interlock, and installation does not require special tools or an unusual degree of manual dexterity.

The simulated shingle arrangement can comprise individual shingles incorporating thereon the novel interlocking system if desired, but it is preferred that it comprise elongated panels each simulating a plurality of individual shingles in side-by-side relation. The use of such panels greatly decreases the time required to cover a given wall or roof area and thus reduces the labor cost for installation. Although such panels may contain any desired and convenient number of simulations of individual shingles, it is particularly preferred to provide two panel designs having the same overall dimensions: one simulating three individual shingles and the other four individual shingles of somewhat narrower width. Such panels are small and light enough to be easily handled and installed by one person, yet enable a substantial area to be covered in a single operation. Since both panel designs have the same overall dimensions, packing and shipping are simplified as well as the calculation of the total number of panels required to cover a given area. The two types of panels can be installed in a random sequence if desired, to simulate the pleasing esthetic appearance of an installation of conventional wooden shingles of random widths.

The simulated shingle arrangement of the present invention, either single shingles or multi-shingle panels, comprise a unitary piece of material making up both the shingle itself and the interlocking means. It can be made from any suitable material which is formable, light in weight, resistant to deterioration from exposure to weathering, and resistant to impact damage. Among suitable materials may be mentioned metals such as steel, aluminum or magnesium, and synthetic polymer compositions such as those based on ABS polymers, polystyrene, polyolefins such as polyethylene or polypropylene, polyurethanes, polyvinylidene chloride, or polyvinyl chloride. It is preferred to use polyvinyl chloride compositions in the practice of the present invention. It will be understood that such compositions can include, in addition to homopolymers or copolymers of vinyl chloride, any of the conventional additives for such polymers, including plasticizers, processing aids, impact modifiers, stabilizers, lubricants, fire retardants, antistatic agents, antimicrobial agents, fillers, ultraviolet absorbers, color pigments, and so on.

The simulated shingle arrangement of the present invention can be made by any convenient method, such as stamping, injection molding, compression molding, thermoforming, or vacuum forming. When utilizing the preferred polyvinyl chloride compositions, a particularly preferred method of making the integral shingle and locking means is to vacuum form a previously calendered sheet of such a composition.

In describing a preferred embodiment of the present invention, the drawing herein utilizes simulated cedar shake shingles for illustrative purposes only, i.e., shingles having striations impressed into their outer surfaces and uneven bottom edges, to simulate the characteristic appearance of wooden, generally cedar, shakes. The present invention is not limited to simulated cedar shakes, but may be utilized with wall or roof coverings simulating any type of shingle with any type of surface, or any other type of wall or roof covering material.

The shingles described herein are hollow, comprising a shell of relatively thin material. They will normally be used in this form but it will be understood that the hollow portion can if desired be filled with any suitable material, such as for example a foamed plastic, without departing from the scope of the present invention.

The simulated shingle arrangement of the instant invention, in its broadest aspect, comprises a generally rectangular shell having a body section, wedge-shaped sidewalls and an end wall, and means integral therewith for interlocking adjacent shingles in the same course, and for interlocking adjacent shingles in adjacent courses. The means for interlocking adjacent shingles in the same course comprises a web attached to the lower edge of one sidewall, the web having an elongated raised portion tapered downward toward the top edge of the shingle. A channel is thus defined by the sidewall, the web, and the raised portion of the web. In order to interlock adjacent shingles in the same course, a sidewall of one shingle is overlapped over the raised portion of the web and seated within the channel. This positioning allows for some lateral adjustment, but effectively locks the adjacent shingles together. The means for locking adjacent shingles in adjacent courses comprises a web attached to a second sidewall near the bottom of the shingle, and a tab attached to the web and extending downward toward the end wall of the shingle. The tab is unattached to the sidewall, and has its edges approximately parallel to the sidewall. The tab lies in a plane parallel to that of the web to which it is attached, and below the plane of the web at a distance equal to or slightly greater than the thickness of the body section. In order to interlock adjacent courses, a lower course of shingles is attached to a wall or roof substrate by means of nails or other conventional fasteners along the upper edge. A second, higher, course is then put into place by slipping the tabs of the shingles of the second course between the substrate and the upper edges of the shingles in the lower course until the upper edge fits snugly against the lower edge of the web to which the tab is attached. The off-set between the planes of the web and tab enables a snug and rainproof fit to be made.

In a preferred embodiment, the shingle arrangement is also provided with mounting areas spaced along the upper edge, comprising flat depressions extending below the under surface of the shingle body section to a depth approximately equal to the thickness of the tabs. These flat depressions can contain nail holes, for convenience in installation. These recessed mounting areas raise the upper edge of the shingle slightly off of the substrate so that the tabs of a following course can be slipped under without causing the upper edge of the lower course to buckle.

In a most preferred embodiment of the instant invention, the shingle arrangement is an elongated panel simulating a plurality of individual shingles in a single course rather than one shingle. In such a panel, the means for locking adjacent shingles in the same course, and the tab means for locking adjacent shingles in adjacent courses are located at the sidewalls at each end of the panel. In addition there are two additional, intermediate, sidewalls for each additional simulated shingle, with an additional web connecting each pair of intermediate sidewalls and an additional tab attached to the end of each additional web.

The tabs maybe flat, but preferably have a protuberance, such as a dome-shaped protuberance extending from the upper surface of the tab near the free end thereof. The protuberance assists in the interlocking action, providing resistance to forces tending to dislodge the tab from below the upper edge of a lower course of shingles.

DESCRIPTION OF THE PREFERRED EMBODIMENTS

Figures 1, 2:
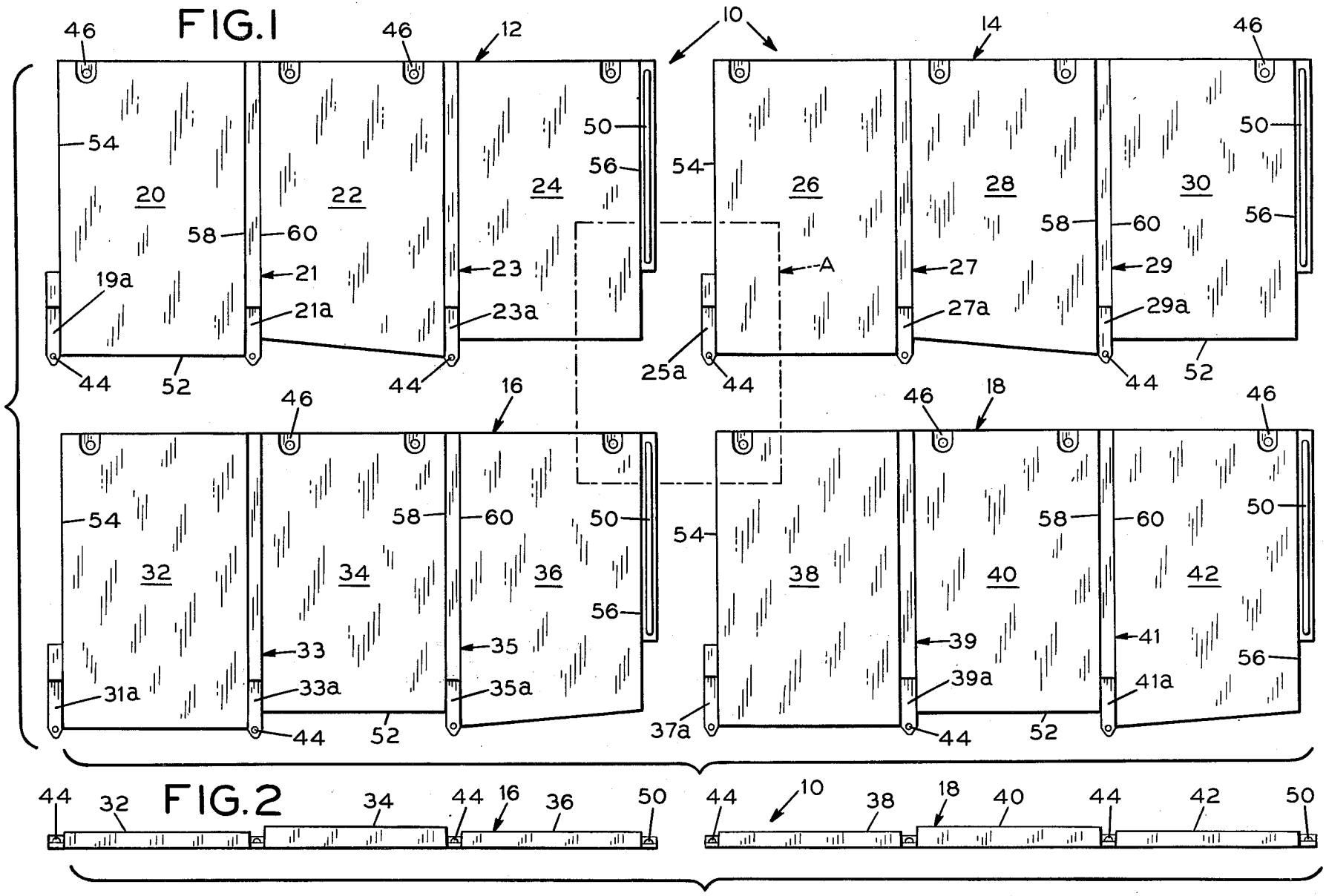
FIG. 1 is an exploded plan view of a plurality of simulated shingle arrangements, each comprising an elongated panel simulating a plurality of individual shingles, before assembly.
FIG. 2 is an end view of the parts shown in FIG. 1, also exploded.
Figure 3:
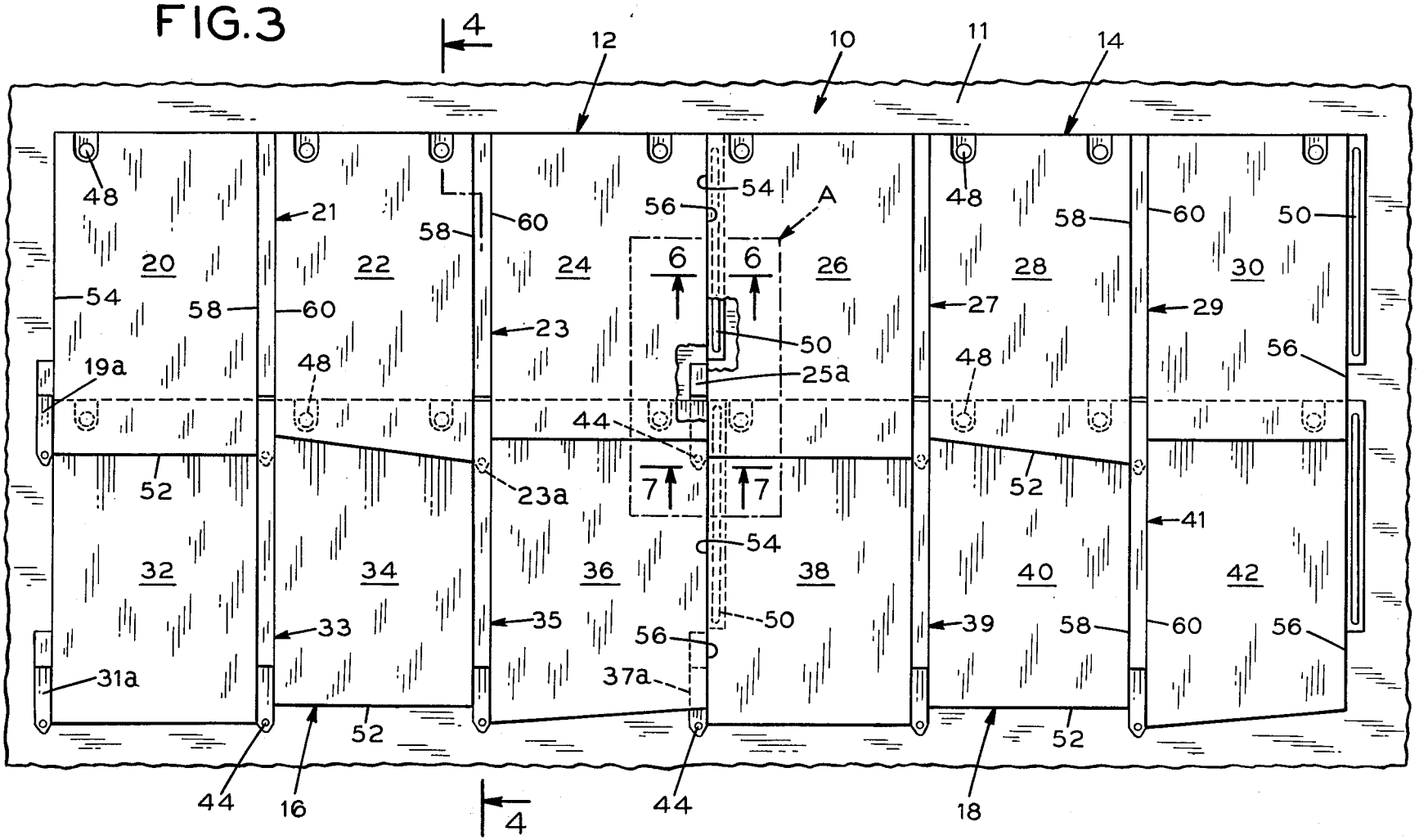
FIG. 3 is a plan view of the parts shown in FIG. 1 after assembly and fastening to a backing substrate.

With reference to the attached drawings, FIG. 1 illustrates a plurality of shingle arrangements of the invention before interlocking, and FIG. 3 shows the same after being assembled and fastened to a backing substrate 11. In FIG. 1 and FIG. 3, 10 shows a whole assembly of four panels 12, 14, 16 and 18. Each panel simulates three individual shingles. Panel 12 is comprised of three body sections 20, 22 and 24, a first wedge-shaped sidewall 56, a second wedge-shaped sidewall 54, two first intermediate wedge-shaped sidewalls 60, two second intermediate wedge-shaped sidewalls 58, end walls 52, a first web with a tapered raised portion 50, a second web and tab assembly 19 with attached tab 19*a*, and additional web and tab assemblies 21 and 23 with attached tabs 21*a* 23*a*.

Similarly, panels 14, 16, and 18 are each comprised of three body sections 26, 28 and 30, 32, 34 and 36, and 38, 40 and 42, respectively, and first sidewalls 56, second sidewalls 54, intermediate sidewalls 60 and 58, and endwalls 52. Each of panels 14, 16 and 18 are also equipped with first webs with tapered raised portion 50, second web and tab assemblies designated 25, 31 and 37 with attached tabs 25*a*, 31*a*, and 37*a*, and additional web and tab assemblies designated 27, 29, 33, 35, 39, and 41 with attached tabs 27*a*, 29*a*, 33*a*, 35*a*, 39*a*, and 41*a*.

In FIGS. 1, 4, 5 and 7 there are shown protuberances 44, preferably dome-shaped protuberances, extending outwardly from the upper surface of the tabs 19*a*, 21*a*, 23*a*, 25*a*, 27*a*, 29*a*, 31*a*, 33*a*, 35*a*, 37*a*, 39*a*, and 41*a*. These protuberances 44 are an optional feature of the invention.

Figure 4:
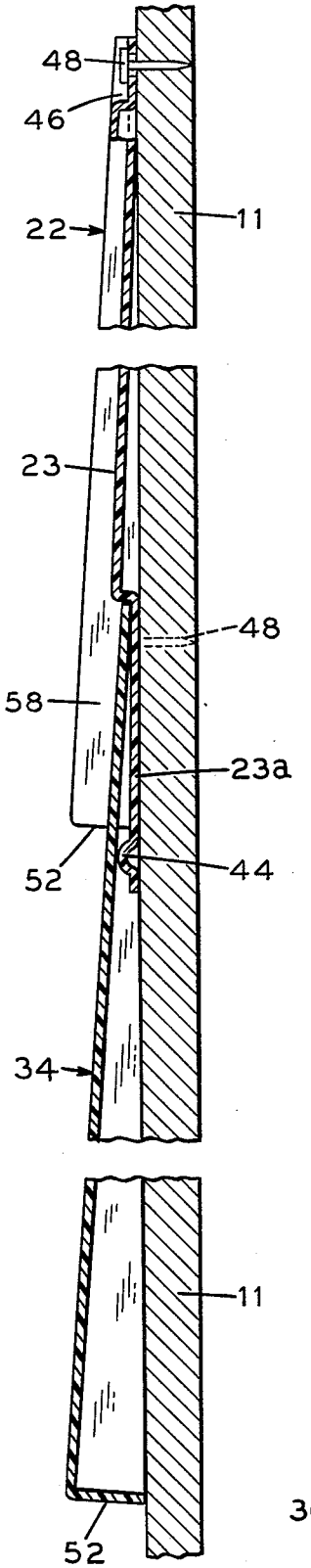
FIG. 4 is a vertical section taken generally along line 4—4 of FIG. 3.
Figure 5:
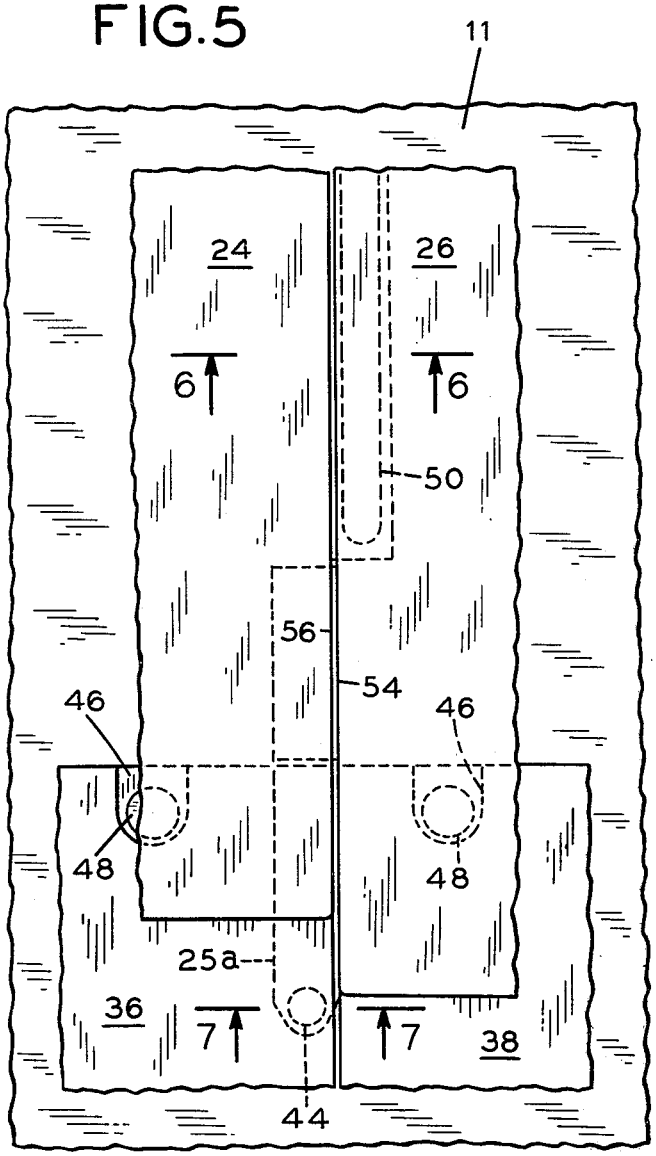
FIG. 5 is an enlarged showing of the portion shown as "A" in FIG. 1 and FIG. 3.

In FIGS. 1, 3, 4 and 5 are shown recessed mounting areas 46, preferrably containing holes for nails or other fasteners. In FIGS. 3, 4 and 5 nails 48 are depicted fastening the shingle arrangements to a substrate 11. It will be understood that the nails 48 do not form a part of the instant invention, and are shown merely for purposes of illustration. It will also be understood that any other suitable fasteners may be used instead of nails, if desired.

Figure 6:
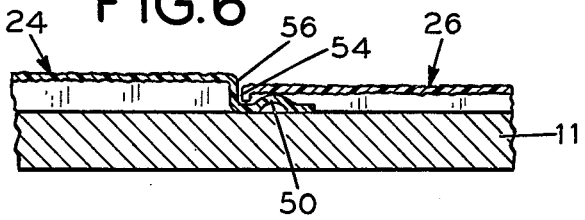
FIG. 6 is a section taken along line 6—6 of FIG. 3 and FIG. 5.
Figure 7:
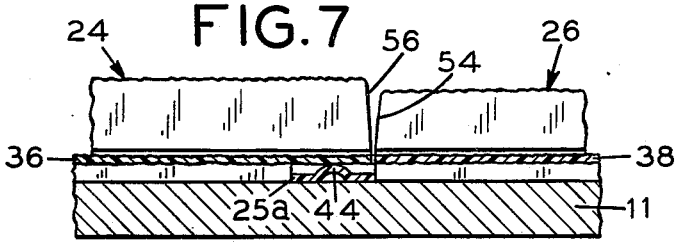
FIG. 7 is a section taken along line 7—7 of FIG. 3 and FIG. 5.

FIG. 3 shows the interlocking mechanism after assembly in portion "A", which can be seen in greater detail in FIG. 5. In FIG. 5, adjacent shingles 24 and 26 in the same course are locked together by the overlapping of tapered raised portion 50 by sidewall 54 of shingle 26. This is also shown in FIG. 6, a section taken along line 6—6 of FIG. 5. FIG. 5 also depicts how adjacent shingles in adjacent courses are interlocked. Tab 25*a*, attached to web and tab assembly 25 of shingle 26 is shown in place between substrate 11 and the top portion of a lower course of shingles represented by panels 16 and 18. This can be seen also in FIG. 7, a section taken along line 7—7 of FIG. 5.

FIG. 4 also shows the interlocking of adjacent shingles in adjacent courses, in vertical section. Tab 23*a* lies between substrate 11 and the upper portion of body section 34. The top edge of body section 34 is placed adjacent the line of junction between tab 23*a* and web 23, the depth of the recess at the line of junction being equal to or slightly greater than the thickness of body section 34 so that rain water running downward along 23 will continue to run downward along 34 rather than being diverted between 23*a* and 34.

FIG. 3 shows panels 12 and 14 assembled directly above panels 16 and 18 in such fashion that web and tab assemblies 19, 21, 23, 25, 27 and 29 are directly above web and tab assemblies 31, 33, 35, 37, 39 and 41. This positioning was made for convenience in depicting the interlocking mechanism, and it will be understood that it is not required that the panels be assembled in such a fashion. It is preferred that the panels in one course be displaced to the right or left with respect to similar panels in adjacent courses so that the completed installation will simulate a desirable random pattern of shingles.

What is claimed is:

1. In a simulated shingle arrangement comprising a generally rectangular shell having a body section equipped along the opposite side edges thereof with inwardly extending first and second sidewalls and along the bottom edge thereof with an inwardly extending end wall section, said sidewalls being tapered from greater dimensions adjacent the bottom of said shingle to reduced dimensions adjacent the top thereof to provide the shingle with a wedge-shaped configuration, and equipped with mounting areas spaced along the upper edge thereof, each of said mounting areas consisting of a flat depression including a nail hole, said depression extending below the under surface of said body section to a depth approximately equal to the thickness of said body section said shell also having cooperable means attached to the lower edge of the first sidewall and extending from the top of said body section toward the bottom thereof for a distance less than the length of said first sidewall and interlockingly engagable with similar shingles adjacent thereto in side-by-side relation and permitting lateral adjustment therebetween and tab locking means comprising a first web attached to the lower edge of the second sidewall beginning at a distance from the top of said second sidewall approximately equal to the length of said cooperable means and extending a part of the way toward the bottom of said second sidewall, and a tab attached to the bottom edge of said first web and extending downwardly to a point between said end wall section, said tab being unattached to said second sidewall to enable the top edge of one shingle to overlap the tab of a second shingle adjacent thereto and to lie beneath the bottom portion of said second shingle in interlocking top-to-bottom relation therewith, the improvement which comprises locating said tab in a plane parallel to the plane of said first web, and below the plane of said first web at a distance equal to or slightly greater than the thickness of said body section, whereby a rainproof joint is provided.

2. A shingle according to claim 1 wherein said tab contains a domelike proturberance extending upwardly from the upper surface thereof.

3. A simulated shingle arrangement according to claim 1 formed to simulate a plurality of shingles in side-by-side relation wherein additional inwardly extending sidewalls partially connected by additional webs define longitudinal grooves simulating the separation between adjacent shingles, said additional webs extending from the top edge of said shingle for a distance equal to the distance from the top edge of said shingle to the bottom edge of said first web, and wherein additional tab locking means are provided comprising an additional tab attached to the bottom edge of each of said additional webs and extending downwardly to a point below said end wall section in a plane parallel to the plane of said additional webs and below the plane of said additional webs at a distance equal to or slightly greater than the thickness of said body section, said additional tabs being unattached to said additional sidewalls.

4. A shingle arrangement according to claim 1 wherein the outer surface is striated to simulated the appearance of wooden shake shingles.

5. A shingle arrangement according to claim 1 made of a thermoplastic material.

6. A shingle arrangement according to claim 5 wherein the thermoplastic material is a polyvinyl chloride composition.

* * * * *